United States Patent [19]

Alderton et al.

[11] Patent Number: 4,516,966

[45] Date of Patent: May 14, 1985

[54] CENTRIFUGES, CENTRIFUGE PLANTS AND FLOW CONTROL ARRANGEMENTS THEREFOR

[75] Inventors: Geoffrey W. Alderton, Warrington; Peter C. Davidge, Holmrook, both of England

[73] Assignee: British Nuclear Fuels Limited, Warrington, England

[21] Appl. No.: 394,883

[22] Filed: Jul. 2, 1982

[30] Foreign Application Priority Data

Jul. 21, 1981 [GB] United Kingdom ..... 8122371

[51] Int. Cl.[3] ..... B04B 7/06

[52] U.S. Cl. ..... 494/1; 55/17; 494/25; 494/32; 494/37

[58] Field of Search ..... 494/25, 26, 31, 32, 494/34, 38, 39, 37, 85; 55/17, 415, 420; 210/136

[56] References Cited

U.S. PATENT DOCUMENTS

| | | | |
|---|---|---|---|
| 3,103,426 | 9/1963 | Lantz | 55/420 |
| 3,251,542 | 5/1966 | Newgard | 494/32 |
| 3,281,067 | 10/1966 | Beyerle | 494/32 |
| 3,613,989 | 10/1971 | Oyama | 494/25 |

FOREIGN PATENT DOCUMENTS

| | | |
|---|---|---|
| 876793 | 9/1961 | United Kingdom . |
| 879118 | 10/1961 | United Kingdom . |
| 1212449 | 11/1970 | United Kingdom . |
| 1425311 | 2/1976 | United Kingdom . |
| 1455689 | 11/1976 | United Kingdom . |

*Primary Examiner*—Robert W. Jenkins

*Attorney, Agent, or Firm*—William R. Hinds

[57] ABSTRACT

In a gas centrifuge assembly comprising a cascade of individual gas centrifuge machines, malfunctioning of any one of the machines as a result of the presence of gaseous impurity within that machine is inhibited from spreading to other machines in the cascade by flow operated valve arrangements in gas flow lines associated with each machine in the cascade. Each valve arrangement is constructed and arranged to close in response to an abnormal gas flow in the line and out of the machine arising from gaseous impurity within the machine. The valve arrangements may be located in some or all of the feed, product and tails lines of each centrifuge machine in the cascade.

6 Claims, 7 Drawing Figures

CENTRIFUGES, CENTRIFUGE PLANTS AND FLOW CONTROL ARRANGEMENTS THEREFOR

This invention relates to gas centrifuges, centrifuge plants and flow control arrangements therefor.

In a plant wherein gaseous mixtures are separated, for example wherein isotopes of uranium in their gaseous hexafluoride form are separated, it is important that the effect of impurity gas within the plant is minimised.

One particular problem which can occur in a gas centrifuge plant for uranium isotope separation, is that of sudden production of light gas if a centrifuge machine should breakdown in use, light gas can spread to adjacent centrifuge machines, causing propagation of breakdowns.

An object of the present invention is to provide a centrifuge, a centrifuge enrichment plant and flow control arrangements therefor, the provision of which tends to mitigate the above mentioned problem.

According to a first aspect of the present invention, in a gas centrifuge assembly comprising a cascade of individual gas centrifuge machines, the improvement is provided comprising flow-operated valve means located in at least one of the gas flow lines associated with each machine in the cascade, the valve means being constructed and arranged to close in response to an abnormal gas flow in the line and out of the machine arising from gaseous impurity within the machine, whereby to inhibit the spread of the impurity to other centrifuge machines in the cascade.

The flow-operated valve means may be located in each of the feed, product and tails lines associated with each centrifuge machine in the cascade.

It is to be understood that, as used above; feed refers to an incoming gaseous mixture to be separated; product and tails refer to outgoing gas streams, the former enriched and the latter depleted in a desired gas. Therefore, in the case of the separation of uranium isotopes as referred to above, the product is enriched in uranium 235 when compared with the feed and the tails is depleted.

Thus, in an abnormal condition such as if a centrifuge machine should breakdown in use so that a sudden rush of light gas is produced, then the flow control arrangement shuts off gas flow and inhibits spread of the light gas, which light gas could induce further breakdowns in adjacent centrifuge machines. The flow control means may advantageously be positioned in the feed line, since this is a line wherein direction of flow changes in abnormal conditions such as if light gas is produced by a machine breakdown. Alternatively, the flow control means may be positioned in the product or tails lines, where there is a sudden increase in flow rate in a breakdown situation.

According to a second aspect of the present invention, a method of protecting a cascade of gas centrifuge machines from the effects of malfunctioning of any one of the machines in the cascade as a result of the presence of gaseous impurity in that one machine comprises locating flow-operated valve means in at least one of the gas flow lines associated with each centrifuge machine in the cascade, the valve means being operable to close in response to an abnormal flow along the line and out of the machine arising from gaseous impurity within the machine whereby to inhibit the spread of the gaseous impurity to other centrifuge machines in the cascade.

In either aspect, at least one of said flow-operated valve means may be normally open and located in a feed line supplying gas to a centrifuge machine, and closes in response to a predetermined attempted gas flow from the machine.

At least one of the flow-operated valve means may be normally open and located in a product or tails line through which gas normally flows from a centrifuge machine, and closes in response to predetermined abnormal attempted gas flow from the machine.

Specific embodiments of the present invention will now be described, by way of example only, with reference to the accompanying drawings, in which.

Figure 1:
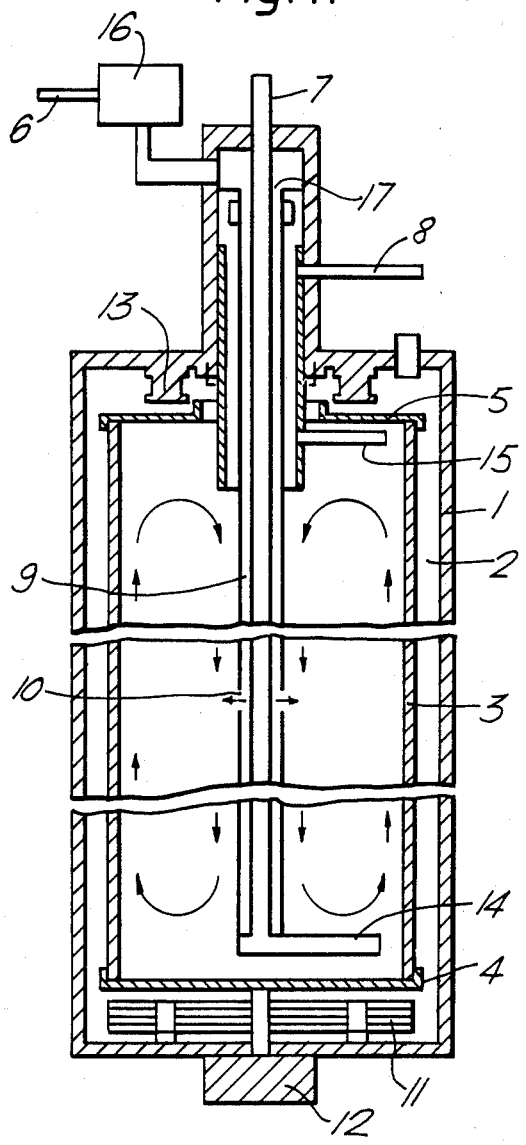
FIG. 1 is a diagrammatic view of a gas centrifuge.

Reference is directed firstly to FIG. 1, in which a housing for a centrifuge is generally indicated by 1. The housing may be a separate housing or it may be part of a block which contains a number of other centrifuges. A centrifuge rotor is generally indicated by 2. The rotor comprises a tube 3 and bottom end cap 4 and top end cap 5. A feed line for the centrifuge is indicated by 6, a product line by 7 and a tails line by 8. In use of the centrifuge, uranium hexafluoride is fed into the centrifuge through the line 6 and passes down annulus 9 into the rotor 2. The annulus 9 contains feed holes 10 about half way down its longitudinal axis, whereby uranium hexafluoride may be fed into the rotor. Rotation of the rotor is effected by a motor 11. The rotor is supported on a bottom bearing 12 and a top bearing 13. A counter current flow of gas within the rotor is induced by temperature difference between the top and bottom of the rotor. Product gas, ie gas enriched in the uranium 235 isotope, is scooped from the bottom of the rotor by scoop 14. Scoop 14 is connected to the product line 7. Tails gas, ie gas depleted in the uranium 235 isotope, is scooped out of the rotor by a scoop 15. The scoop 15 is connected to the tails line 8. The product gas is the light fraction of the centrifuge mixture and the tails gas is the heavy fraction thereof. One or more of the feed, product and tails lines may contain a flow control arrangement 16 outside the centrifuge and/or a flow control arrangement at a location such as generally indicated at 17 within the centrifuge. It is to be understood that any of the flow restricting devices described below can be interchangeably mounted at positions indicated by 16 and 17.

Figure 2:
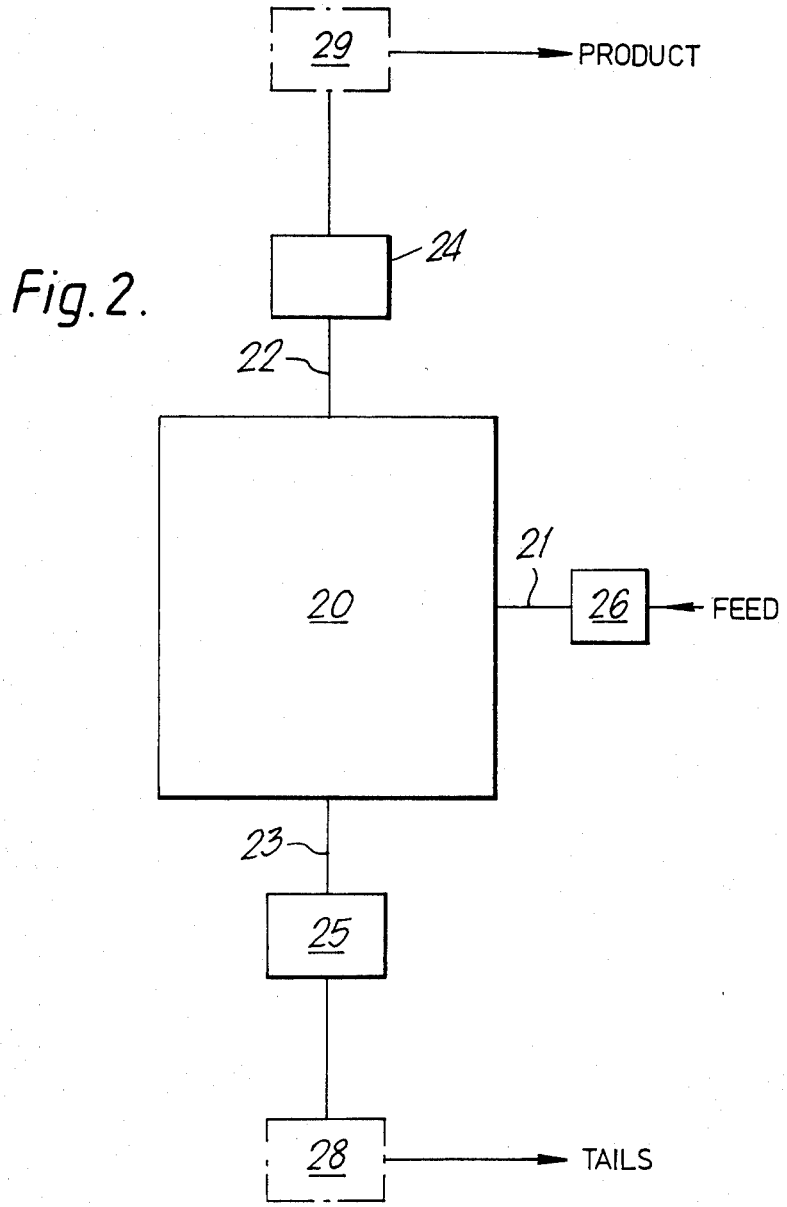
FIG. 2 is a diagrammatic view of a centrifuge plant.

Reference is now directed to FIG. 2, in which a separative unit is indicated by 20. The separative unit is a block of centrifuge machines (not shown) like the machine described above in connection with FIG. 1. The separative unit has a feed line indicated by 21, a product line by 22 and a tails line by 23. A flow control arrangement 26 is disposed in the feed line, a flow control arrangement 24 in the product line and a flow control arrangement 25 in the tails line. In a centrifuge plant, a number of separative units may be arranged in stages, and in FIG. 2, stages on the tails side of the separative unit 20 are indicated by 28 and separative units on the product side of the separative unit 20 are indicated by 29. Other types of centrifuge plant may comprise a plurality of individual centrifuge machines arranged in stages.

Figure 3:
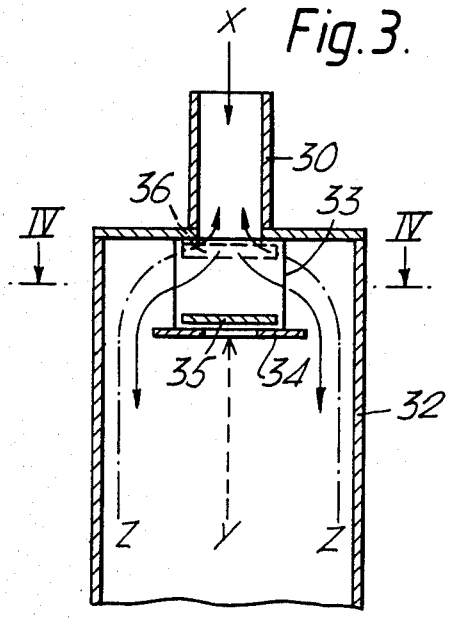
FIG. 3 is a diagrammatic vertical section of a first flow control arrangement.
Figure 4:
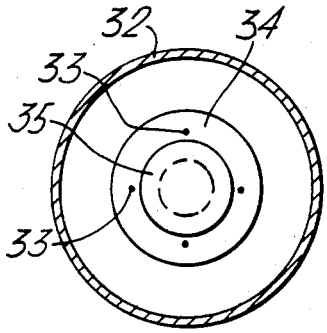
FIG. 4 is a section on III—III of FIG. 3.

Reference is now directed to FIGS. 3 and 4, wherein a first embodiment of flow control arrangement is shown in more detail. The flow control arrangement of FIGS. 3 and 4 can be disposed in any one of the feed, product and tails lines mentioned above. For the purposes of explanation, it is to be assumed that the arrangement of FIGS. 3 and 4 is disposed in the feed line 6 of the centrifuge described above in connection with FIG. 1. The flow control arrangement comprises a valve arrangement having a first conduit indicated by 30 and a second conduit indicated by 32. A gas tight path is formed in the conduits 30 and 32. Four suspension pins 33 suspend an annular ring 34 below the conduit 30. The ring 34 supports a disc 35. The disc 35 has a diameter which is sufficient to enable it to block the conduit 30. In normal operation of the valve arrangement, gas is fed from the conduit 30 to the conduit 32 along a path generally indicated by solid arrows referenced by X. If an abnormal fault situation should arise for reasons which will be made clear below, then a reverse gas flow will attempt to take place as indicated by the broken arrow referenced by Y. The mass per unit area of the disc 35 is so chosen that this reverse flow is able to lift the disc 35 upwardly until it occupies a position indicated in broken lines and referenced by 36. When the disc is in this position, the conduit 30 is sealed off from gas attempting to flow into it from the conduit 32. When normal conditions of gas flow return, then the disc 35 falls to the position shown in solid lines under the action of gravity.

The valve arrangement of FIGS. 3 and 4 can also be employed in the tails line as mentioned above. In this situation, the normal gas flow is in a direction indicated by the broken arrows Y. In fact, gas flows along a path indicated by chain dot lines Z. In the tails line, the mass per unit area of the disc 35 is so chosen that the normal flow pressure along the line Z is insufficient to lift the disc 35 into the position shown at 36. However, in an abnormal situation as will be described below, there is a sudden attempted egress of gas along the tails line so that there is a sudden increase in gas flow and consequently in pressure. This increase in pressure is sufficient to lift the disc 35 upwardly until it adopts the position shown at 36. Therefore, the tails line becomes shut in fault conditions.

Figure 5:
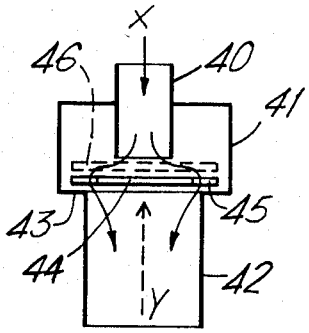
FIG. 5 is a similar view to FIG. 3 but showing a diagrammatic form of a second embodiment of flow control arrangement.
Figure 6:
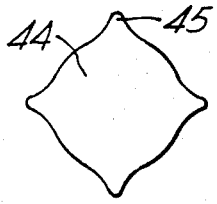
FIG. 6 shows a detail of FIG. 5 in plan.

Reference is now directed to FIGS. 5 and 6, in which there is shown a second embodiment of valve arrangement. In this embodiment, there is a gas tight path between a conduit 40 and a conduit 42, via a portion 41 of enlarged diameter, which portion provides shoulders 43. The shoulders 43 provided a support for a lifting disc 44. The lifting disc 44 has pips 45 which rest upon the shoulders. Otherwise, the disc has a radius which is less than that of the conduit 42. Therefore, while the disc 44 is resting upon the shoulders 43, a path is provided for gas to flow from the conduit 40 to the conduit 42. Such flow would be in a direction indicated by solid arrows X. Such flow is normal flow. However, in an abnormal situation in the feed line, a reverse flow would tend to take place along a line indicated by dotted lines Y, for reasons which will be explained below and have been mentioned above in connection with FIGS. 3 and 4. In this abnormal situation, the disc 44 would be lifted to a position shown dotted and indicated by 46. In this position, a conduit 40 is blocked because a radius of the disc 44 is greater than the radius of conduit 30. Therefore, flow in a direction indicated by Y is restricted. The mass per unit area of the disc 44 is so chosen that it will be lifted in abnormal situations. When the valve arrangement is disposed in the tails line, then the direction of normal flow is as indicated by Y, the flow in fact being in the reverse direction to the arrows indicated by X. However, in an abnormal situation, the gas flow is suddenly increased by a large amount, so that sufficient force is provided to lift the disc 44 to the position shown dotted at 46. Therefore, flow in the direction Y is restricted.

Figure 7:
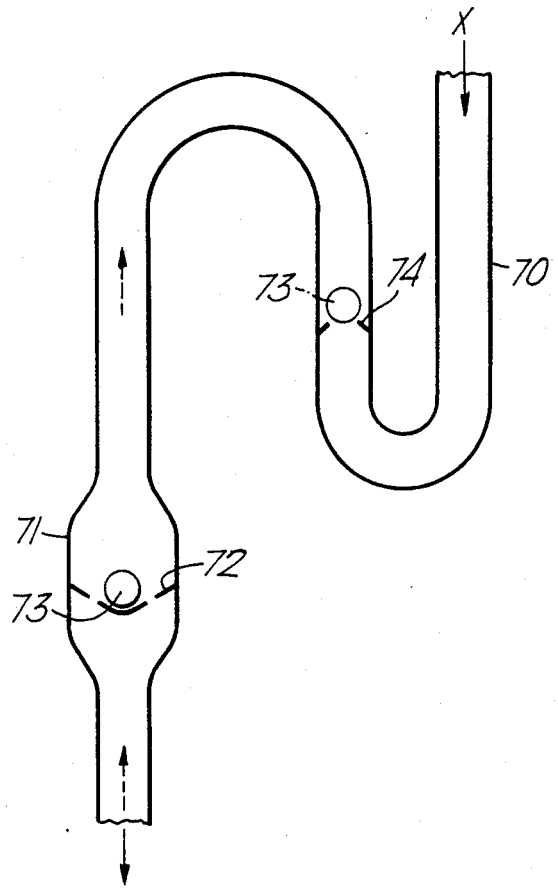
FIG. 7 is a diagrammatic view of a third embodiment of flow control arrangement.

Reference is now directed to FIG. 7, in which a third embodiment of valve arrangement is shown. The arrangement comprises a generally 'N'-shaped pipe 70. Feed into the pipe 70 is indicated by X. At the tail end of the pipe 70, there is provided a bulbous portion 71. The bulbous portion 71 carries a support 72 for a ball 73. The support 72 is permeable to gas, comprising typically a mesh arrangement. In the mid region of the pipe 70, there is situated a rest 74 for the ball 73, which is shown dotted in this operational position, as will be explained below. In operation of the valve arrangement, gas normally flows through the pipe 70 as is indicated by the solid arrow. There is space around the ball 73 at the tail exit of the pipe 70 for the gas to pass through, and the gas can then pass through support 72, thence into the rotor, when the valve arrangement is disposed in the feed line. However, should the gas tend to flow in the reverse direction as is indicated by the broken lines in the figure, then the ball 73 is lifted into the pipe 70. When the ball is within the pipe 70, reverse flow through the pipe is inhibited.

If the pressure of the reverse flow should continue, then the ball will be lifted up the tube 70 and around a bend, until it reaches a rest 74. At this point, the ball cannot advance any further and the flow is blocked. Once the ball has reached this position on the rest, the machine is shut off from the gas supply. If, inadvertently, the ball were to get on to its seat, it could be easily reset by means of, for example, a magnet which could be moved adjacent to the pipe 70 to reset the ball. With correct adjustment of the dimensions of the pipe 70 and the weight of the ball 73, the resetting could be effected by normal pressure of feed uranium hexafluoride in normal operating conditions, if and when these were to be restored. This is because a pressure difference would exist to move the ball back for a running centrifuge but not for a failed one.

The valve arrangement of FIG. 7 could also be used in the tails line, in which case flow direction under normal circumstances would be in a sense opposite to the direction indicated by the solid arrows X. Normal flows and pressures would be insufficient to lift the ball 73 into the pipe 70, the mass and dimensions of a ball and pipe being so chosen that this situation existed. However, in failure conditions, to be described below, a sudden increase in gas flow would occur and this sudden increase would provide sufficient pressure to lift the ball into the pipe and onto its seat. In use of the valve arrangement in the tails pipe, resetting needs to be done with the use of an external means as explained above, since, even in normal conditions, there would be no flow in a direction indicated by X.

In normal operation of a centrifuge plant for the enrichment of uranium hexafluoride with its uranium 235 isotope, the flows of gas are as described above in connection with FIG. 1. However, in a fault situation, light gas is given rise to. This light gas might, in some circumstances, be the atmosphere which has leaked into the centrifuge plant, but in most circumstances it will be generated as a result of failure of a centrifuge. The generation is a result of a mechanical interaction of fast moving parts of a damaged rotor with other components of a centrifuge assembly, such that frictional forces and heat tend to cause production of light gases. When light gases so evolve from a broken machine, what happens is that there is a sudden rapid outflow of light gas from the machine. It is important for plant efficiency and the inhibiting of damage to other centrifuge machines that any light gas formed by the failure of a centrifuge should not be able to penetrate throughout the plant in an uncontrolled fashion, ie sufficiently quickly to render operational machines unstable or damage them in any way such as by causing overheating.

Therefore, the use of flow restricting means as described above in one or more of the feed, product and tails lines can represent a important saving to the plant, because rapid outflow of gas, which would occur from a failed centrifuge, is inhibited or restricted. Thus, the failure of one centrifuge machine is not transmitted to other adjacent machines, in for example the same centrifuge block.

The device of FIG. 7, which remains in the shut position would also have an advantage insofar as it would reduce loss of pressure in the system from a failed centrifuge, which would allow for smaller interstage piping and higher enrichment.

In the cases of the first two embodiments of flow control arrangements described above, the moving parts are designed such that the disc cannot tilt over a jam nor fail to cover the end of the pipe when lifted.

In some arrangements, fluidic diodes could be used as flow control arrangements.

From the above description, it can be seen that the present invention provides an improved centrifuge, centrifuge plant and flow control means therefor.

We claim:

1. In a gas centrifuge assembly comprising a cascade of individual gas centrifuge machines, the improvement comprising flow-operated valve means located in at least one of the gas flow lines associated with each machine in the cascade, the valve means being constructed and arranged to close in response to an abnormal gas flow in the line and out of the machine arising from gaseous impurity within the machine, whereby to inhibit the spread of the impurity to other centrifuge machines in the cascade.

2. An assembly according to claim 1 including feed, product and tails lines associated with each centrifuge machine in the cascade, with said flow-operated valve means located in each of said lines.

3. An assembly according to claim 1 wherein at least one of said flow-operated valve means is normally open and located in a feed line supplying gas to a centrifuge machine, and closes in response to a predetermined attempted gas flow from the machine.

4. An assembly according to claim 1 wherein at least one of said flow-operated valve means is normally open and located in a product or tails line through which gas normally flows from a centrifuge machine, and closes in response to predetermined abnormal attempted gas flow from the machine.

5. A method of protecting a cascade of gas centrifuge machines from the effects of malfunctioning of any one of the machines in the cascade as a result of the presence of gaseous impurity in that one machine, the method comprising locating flow-operated valve means in at least one of the gas flow lines associated with each centrifuge machine in the cascade, the valve means being operable to close in response to an abnormal flow along the line and out of the machine arising from gaseous impurity within the machine whereby to inhibit the spread of the gaseous impurity to other centrifuge machines in the cascade.

6. A method according to claim 5 which comprises locating said flow-operated valve means in the feed, product and tails lines of each centrifuge machine in a cascade.

* * * * *